US005705762A

United States Patent [19]

Kang et al.

[11] Patent Number: 5,705,762

[45] Date of Patent: Jan. 6, 1998

[54] DATA FORMAT AND APPARATUS FOR SONG ACCOMPANIMENT WHICH ALLOWS A USER TO SELECT A SECTION OF A SONG FOR PLAYBACK

[75] Inventors: Jae-yong Kang; Gyoung-chan Park, both of Suwon, Rep. of Korea

[73] Assignee: Samsung Electronics Co., Ltd., Kyungki-do, Rep. of Korea

[21] Appl. No.: 508,689

[22] Filed: Jul. 28, 1995

[30] Foreign Application Priority Data

Dec. 8, 1994 [KR] Rep. of Korea ..... 94-33362

[51] Int. Cl.[6] ..... G10H 1/36; G10H 7/00

[52] U.S. Cl. ..... 84/610; 84/634; 84/645

[58] Field of Search ..... 84/610, 634, 645

[56] References Cited

U.S. PATENT DOCUMENTS 5,194,682 3/1993 Okamura et al. ..... 84/645 X
5,233,438 8/1993 Funahashi et al. .
5,294,745 3/1994 Yamauchi et al. ..... 84/645 X
5,410,097 4/1995 Kato et al. ..... 84/610
5,506,370 4/1996 Nakai et al. .

*Primary Examiner*—William M. Shoop, Jr.
*Assistant Examiner*—Jeffrey W. Donels
*Attorney, Agent, or Firm*—Sughrue,Mion, Zinn, Macpeak & Seas, PLLC

[57] ABSTRACT

A data format is provided for song accompaniment which includes pointers indicating a starting position of accompaniment data and lyrics data in every section of a song is provided. The data format includes a lyrics data portion having lyrics data; an accompaniment data portion having accompaniment data corresponding to the lyrics data of the lyrics data portion; and a header portion having a plurality of pointer pairs, each pointer pair being composed of one pointer indicating the front position of each section in the lyrics data of the lyrics data portion and the other pointer indicating the front position of accompaniment data corresponding to the front position of each section. The data format has a header portion including pointers indicating the starting position of a section, thereby allowing the synchronization of the lyrics and accompaniment data of every section during the reproduction of a data format.

1 Claim, 2 Drawing Sheets

DATA FORMAT AND APPARATUS FOR SONG ACCOMPANIMENT WHICH ALLOWS A USER TO SELECT A SECTION OF A SONG FOR PLAYBACK

BACKGROUND OF THE INVENTION

The present invention relates to a data format and apparatus for song accompaniment, and more particularly, to a data format including pointers indicating the starting position of accompaniment data and lyrics data in every section of a song and an apparatus therefor.

The song-accompaniment apparatus, commonly called a karaoke machine, displays song lyrics on a display device while reproducing a song accompaniment signal so that people can sing along to the accompaniment while viewing the displayed lyrics. Recently, this kind of apparatus has become popular for home use as well as commercial use.

A song-accompaniment apparatus which adopts a compact disk, a semiconductor memory and the like, where digital accompaniment data is recorded, is more widely used than an apparatus which adopts a laser disk where a sampled analog accompaniment signal is recorded.

A karaoke apparatus using digital accompaniment data stores the accompaniment signal and lyrics data according to the musical instrument digital interface (MIDI) standard and reads out the accompaniment and lyrics data corresponding to the selected song. Here, the accompaniment data is reproduced as an audio signal via a sound processor and the lyrics data is displayed on the screen of an image display device via a character signal generator.

Such an apparatus maintains the synchronization of lyrics and accompaniment data using the channel data contained among the accompaniment data. That is, generally, when specific channel data is generated from the accompaniment data, the lyrics data is controlled to be displayed on the screen by a unit of measure. This means that the lyrics data progress relative to the progression of the accompaniment data, so there is no absolute corresponding relation between the data positions. Thus, there is no way to quickly advance the singing by omitting the front or rear part of the selection when the selected song is very long.

SUMMARY OF THE INVENTION

It is an object of the present invention to provide a data format for song accompaniment in which the lyrics and accompaniment data are reproduced being synchronized in section units.

It is another object of the present invention to provide an apparatus for song accompaniment which is suitable for the above data format.

To achieve the above first object, the data format for song accompaniment according to the present invention comprises: a lyrics data portion having lyrics data; an accompaniment data portion having accompaniment data corresponding to the lyrics data of the lyrics data portion; and a header portion having a plurality of pointer pairs, each pointer pair being composed of one pointer indicating the front position of each section in the lyrics data of the lyrics data portion and the other pointer indicating the front position of accompaniment data corresponding to the front position of each section.

The song-accompaniment apparatus suitable for the above data format, comprises: an accompaniment data memory for storing accompaniment data; a lyrics data memory for storing lyrics data; an accompaniment signal generator for generating an accompaniment signal based on the accompaniment data read out from the accompaniment data memory; a lyrics signal generator for generating an image signal based on the lyrics data read out from the lyrics data memory; a section selection signal generator for generating a section selection signal of a data format in response to an operating command provided by a user; and a controller for obtaining the starting position of the lyrics and accompaniment data by referring to the pointer pair corresponding to the section selected in response to the section selection signal generated from the section selection signal generator and for controlling the operation generating the lyrics signal together with the reproduction of the accompaniment signal according to the obtained starting positions of data.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
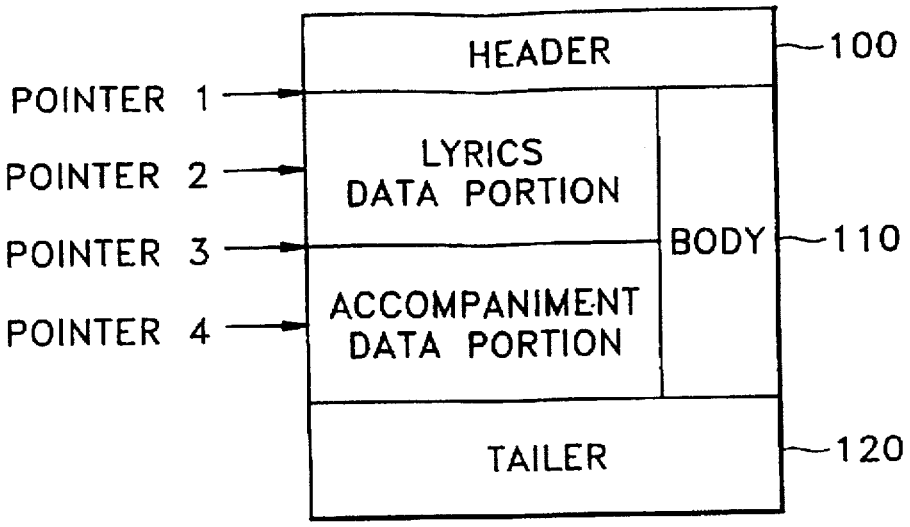
FIG. 1 is a diagram showing the construction of a data format according to the present invention.

The data format shown in FIG. 1, which shows the construction of a data format according to the present invention, is composed of a header 100, a body 110 and a tailer 120. The information about a header identification code, header size, body size and the overall size of the pointers and data format are recorded in header 100 of a data format. Also, MIDI data for accompaniment and lyrics data are recorded in body 110. In FIG. 1, pointer 1 represents the front position of lyrics data in a first section, pointer 2 represents the front position of lyrics data in a second section, pointer 3 indicates the front position of the accompaniment data corresponding to the front position of lyrics data in a first section, and pointer 4 indicates the front position of the accompaniment data corresponding to the front position of lyrics data in a second section. The synchronization of accompaniment and lyrics data is performed by control data inserted into the accompaniment data.

The MIDI data format is shown in the following Table 1.

TABLE 1

| message | command | state byte | number of data bytes |
|---|---|---|---|
| channel message | note OFF | 8X | 2 |
| | note ON | 9X | 2 |
| | poly-phonic key | AX | 2 |
| | press | BX | 2 |
| | control change | CX | 1 |
| | program pressure | DX | 1 |
| | channel pressure | EX | 2 |
| | pitch foil change | | |
| system message | exclusive change | E0 | |
| | cutter frame change | E1 | optional |

TABLE 1-continued

| message | command | state byte | number of data bytes |
|---|---|---|---|
| | song position | E2 | 1 |
| | pointer | E3 | 2 |
| | song selector | E6 | 1 |
| | tune request | E7 | — |
| | end of exclusive | E8 | — |
| | timing clock | EA | — |
| | start | EB | — |
| | continue | EC | — |
| | stop | EE | — |
| | active sensing | FF | — |
| | system reset | | — |

The MIDI signal is composed of one state byte and at least one data byte. The MIDI signal is roughly classified into a channel message and a system message according to the state byte. Also, the channel message is again classified into a voice message and a mode message and the system message is classified into an exclusive message, a common message and a real-time message. The channel message, as shown in FIG. 2, represents information for the kind of instrument (channel) to be played for the interval (note number) and stress (velocity) thereof and starting and stopping the generation of a tone.

Figure 2:
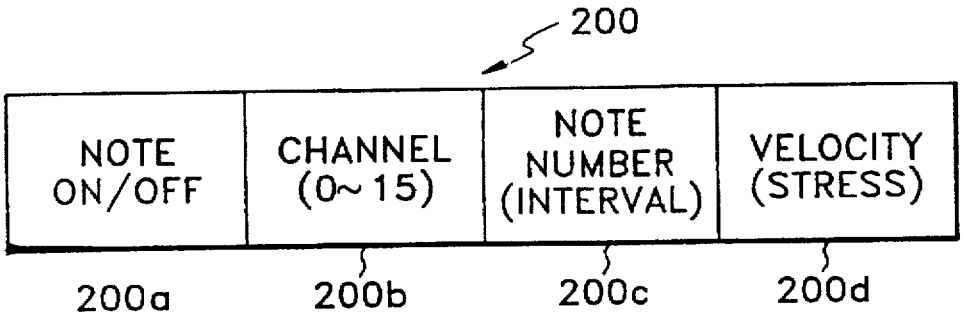
FIG. 2 is a diagram showing a data format of channel message among MIDI-data.

FIG. 2 is a diagram showing a data format of channel message among MIDI-data. In FIG. 2, channel message 200 has note on/off data 200*a*, channel data 200*b*, note number data 200*c* and velocity data 200*d*. Note on/off data 200*a* is a signal of four bits for controlling the on/off operation of a specific tone of an instrument designated by the following channel data and note number data. Channel data 200*b*, which is four-bit data for determining the kind of instrument, determines the tone of an instrument generated from an accompaniment signal generation 24. Since this channel data is a signal of four bits, a maximum of sixteen instruments can be designated. Note number data 200*c* determines the interval of an instrument designated by channel data 200*b*. Velocity data 200*d* determines the stress of the selected interval. Also, information for controlling lyrics display is recorded in a specific channel message.

Figure 3:
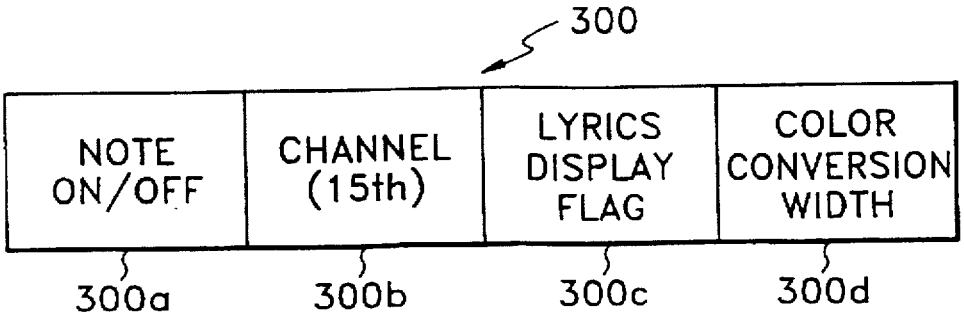
FIG. 3 is a diagram showing a channel message having information for controlling lyrics display.

FIG. 3 is a diagram showing a channel message having information for controlling lyrics display and an example applied to a fifteenth channel. In FIG. 3, channel message 300 for controlling lyrics display has note on/off data 300*a*, channel data 300*b*, a lyrics display flag 300*c* and color conversion width data 300*d*. Channel data 300*b* is for displaying the fifteenth channel. The content of lyrics display flag 300*c* is as follows.

1) Display flag: a flag for indicating display of the information of a next measure on the screen.
2) Eliminate flag: a flag for indicating erasure of the information of one measure being displayed on the current screen.
3) Color conversion flag: a flag for indicating color-conversion of the lyrics characters being currently sequentially displayed.

Channel message 300 is for controlling the display of lyrics associated with a sound which corresponds to the lyrics to be pronounced, so that the characters can be color-converted according to the progress of the accompaniment signal.

Color conversion width data 300*d* is for determining the speed of the color conversion during the color-conversion operation of a lyrics character. The lyrics character generated from lyrics signal generator 14 is a character signal of bit-map font in a size of n×m pixels. Color conversion width data 300*d* is for determining the number of pixels to be color-converted at a time. According to this data, it is determined whether the color of one character is slowly converted or is converted all at once.

For example, when several tempos are assigned to the lyrics of one note, the value of color-conversion width data 300*d* is reduced, and when one tempo is assigned to the lyrics of a plurality of notes, the value of color-conversion width data 300*d* is increased, so that the progression of the accompaniment signal and the lyrics are controlled to be nearly consistent with each other.

Figure 4:
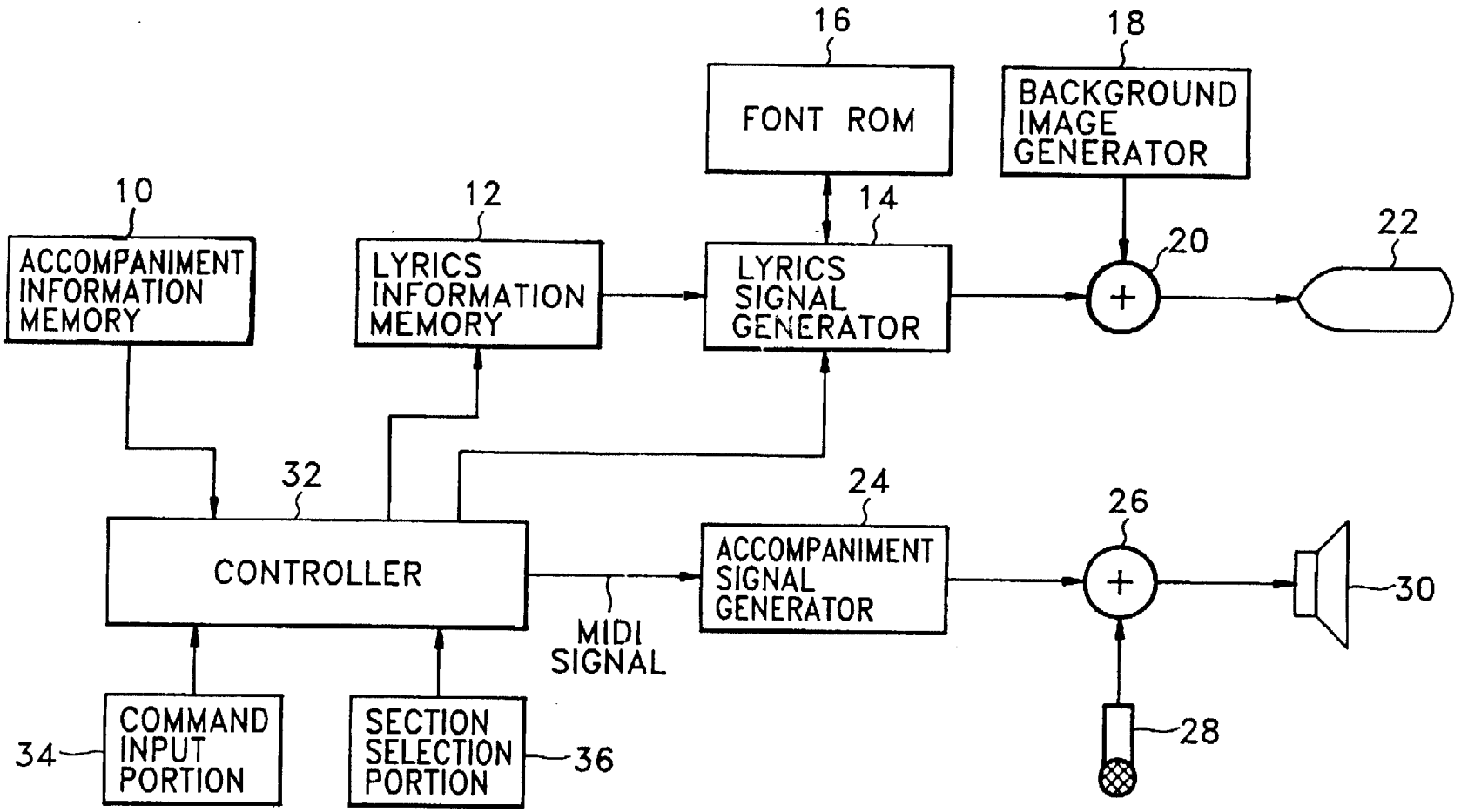
FIG. 4 is a block diagram showing an apparatus for song accompaniment according to the present invention.

FIG. 4 is a block diagram showing an apparatus for song accompaniment according to the present invention. In the apparatus shown in FIG. 4, reference numeral 10 is an accompaniment information memory for storing the accompaniment information with respect to a plurality of instruments, reference numeral 12 is a lyrics information memory, and reference numeral 14 is a lyrics information generator for converting the lyrics information into an image signal having a bit-map font for storage and for scanning the signal in a predetermined period so as to output the character image signal. Reference numeral 16 is a font ROM for storing the bit-map font corresponding to the lyrics information, reference numeral 18 is a background image generator for generating a background image, and reference numeral 20 is an image synthesizer for synthesizing the first image signal representing the lyrics signal generated from lyrics information generator 14 and the second image signal generated from background image generator 18 and outputting the result to a monitor 22. Reference numeral 24 is an accompaniment signal generator for generating the accompaniment signal based on the accompaniment information of each instrument, reference numeral 26 is a sound synthesizer for synthesizing the accompaniment signal generated from accompaniment signal generator 24 and the sound signal of a singer input via a microphone 28, and outputting the result to a speaker 30, and reference numeral 32 is a controller for reading out the accompaniment information stored in accompaniment information memory 10 so as to be provided to accompaniment signal generator 24 and for controlling lyrics information memory 12 and lyrics signal generator 14 so as to control the display operation of lyrics information at the same time. Reference numeral 34 is a command input portion for directing the functions for selection, reservation and reproduction of data format and instrument selection, and reference numeral 36 is a section selection portion for selecting a section of a data format.

The apparatus for song accompaniment according to the present invention receives the section selection signal generated from section selection portion 36 and reproduces the lyrics and accompaniment data, referring to the pointer pair corresponding to the section stored in the header portion of a data format.

Section selection portion 36 is made of a switch device where the value is increased for every operation of the switch device and can be composed of a toggle switch since most songs are composed of two sections. Also, the section selection signal can be generated by a method where the user manually inputs the selection details through a selection menu displayed on the display device via software.

Now, the operation of the apparatus shown in FIG. 4 will be described in detail.

When a song number is selected through command input portion 34, the corresponding data format having the construction shown in FIG. 1 is read out from the recording medium (not shown).

Among the read corresponding data format, the accompaniment data is stored in accompaniment information memory 10 and the lyrics data is stored in lyrics information memory 12. On the other hand, the pointers are stored in the buffer memory of controller 32 and are used as a reference for selecting a section.

Section selection portion 36 generates the section selection signal according to the operation of section selection. When no operation for selecting a section is provided, the section selection signal having a default value is generated. Controller 32 starts to reproduce the corresponding part of the lyrics and accompaniment data in response to the section selection signal. When the section selection signal has the default value, controller 32 reproduces the lyrics and accompaniment data from the first part thereof, by referring to pointers 1 and 3, and when the section selection signal is not the default signal, the reproduction is performed by referring to the corresponding pointer.

When the section selection signal indicates reproduction from a second section, the reproduction is performed from the position indicated by pointers 2 and 4.

When the section selection signal is input via section selection portion 36 during reproduction of the first section, the lyrics and accompaniment data of the selected section are immediately reproduced, by referring to the corresponding pointer.

When the section selection signal indicating the first section is input via section selection portion 36 during reproduction of the first section, the input selection signal is disregarded.

As described above, the data format according to the present invention has a header portion including pointers indicating the starting position of a section, thereby synchronizing the lyrics and accompaniment data of every section during the reproduction of a data format.

The apparatus for song accompaniment according to the present invention can reproduce a song by a section, so that the user sings a song by selecting the first or second section according to the operation of section selection portion 36.

What is claimed is:

1. An apparatus for song accompaniment which displays the lyrics of a song on a display device while reproducing an accompaniment signal, said apparatus comprising:

an accompaniment data memory for storing accompaniment data;

a lyrics data memory for storing lyrics data of a song, said lyrics data being divided into sections;

an accompaniment signal generator for generating an accompaniment signal based on the accompaniment data read out from said accompaniment data memory;

a lyrics signal generator for generating an image signal based on the lyrics data read out from said lyrics data memory;

a section selection signal generator for generating a section selection signal of a data format, in response to an operating command provided by a user; and a controller for obtaining a starting position of one of the sections of the lyrics data and a starting position of the accompaniment data by referring to a pointer pair corresponding to a section selected in response to the section selection signal generated from said section selection signal generator and for controlling generation of the lyrics signal together with production of the accompaniment signal according to the obtained starting position of the section of the lyrics data and the obtained starting position of the accompaniment data.

* * * * *